US005195436A

United States Patent [19]

Valditerra

[11] Patent Number: 5,195,436

[45] Date of Patent: Mar. 23, 1993

[54] PROCESS FOR CONTINUOUS WELDING OF TRACK SECTIONS, AND SET OF WAGONS ESPECIALLY EQUIPPED FOR ITS IMPLEMENTATION

[76] Inventor: Sergio Valditerra, Viale Rimembranze 67, I-15067 Novi Ligure, Italy

[21] Appl. No.: 640,405

[22] PCT Filed: May 8, 1990

[86] PCT No.: PCT/EP90/00819

§ 371 Date: Apr. 29, 1991

§ 102(e) Date: Apr. 29, 1991

[87] PCT Pub. No.: WO90/14470

PCT Pub. Date: Nov. 29, 1990

[30] Foreign Application Priority Data

May 23, 1989 [IT] Italy ..... 67386 A/89

[51] Int. Cl.[5] ..... E01B 29/17

[52] U.S. Cl. ..... 104/15; 104/2

[58] Field of Search ..... 104/15, 2, 7.1, 5; 219/53, 54, 59

[56] References Cited

U.S. PATENT DOCUMENTS

| | | | |
|---|---|---|---|
| 3,896,734 | 7/1975 | Plasser et al. | 104/2 |
| 4,232,610 | 11/1980 | Theurer | 104/15 |
| 4,236,453 | 12/1980 | Collen | 104/15 |
| 4,272,664 | 6/1981 | Theurer | 104/15 |
| 4,313,382 | 2/1982 | Bommart | 104/15 |
| 4,325,306 | 4/1982 | Valditerra | 104/2 |
| 4,641,818 | 2/1987 | Bommart | 104/15 |
| 4,716,836 | 1/1988 | Hardt | 104/15 |
| 4,867,068 | 9/1989 | Valditerra | 104/2 |

FOREIGN PATENT DOCUMENTS

| | | | |
|---|---|---|---|
| 1571796 | 6/1969 | France . | |
| 0347148 | 3/1937 | Italy | 104/15 |
| 1137137 | 1/1985 | U.S.S.R. | 104/15 |
| 2159449 | 12/1985 | United Kingdom . | |
| 2159557 | 12/1985 | United Kingdom . | |
| 2172563 | 9/1986 | United Kingdom . | |

*Primary Examiner*—Mark T. Le

*Attorney, Agent, or Firm*—Young & Thompson

[57] ABSTRACT

A process for the continuous welding of railroad rail sections (3) during the laying down thereof, involves a particularly equipped train set (5-5'), formed by one or more trucks (5,5') having a lowered load platform inserted into the operating train, between the trucks (1) which carry the new rail sections (3) and ties (2), and the operating machine which lays them down. On board this equipped train set (5-5') there are performed the operations for arranging to line, to level and to abut the subsequent rail sections (3), as well as their welding, by welding machines (15-17) which are movable on a trolley (8) along the train set (5-5'). The welding operation is performed during a stroke of the trolley (8) with the welding machines (15-17) in a direction opposite the forward direction of the operating train, and the welding stroke is subsequently compensated by a return stroke of the trolley (8) with the welding machines (15-17) in the same direction as the forward direction of the operating train, whereby the whole welding operation is accomplished on board the operating train itself, and the laying down of new rails is done by the correspondingly operating machine on already continuous rails.

10 Claims, 3 Drawing Sheets

PROCESS FOR CONTINUOUS WELDING OF TRACK SECTIONS, AND SET OF WAGONS ESPECIALLY EQUIPPED FOR ITS IMPLEMENTATION

BACKGROUND OF THE INVENTION

1. Field of the Invention

The subject of the present invention is a process for the continuous welding of railroad rail sections during the laying down thereof, and a train set particularly equipped in order to carry out this process.

2. Description of Related Art

According to the conventional procedure in laying down the railroad rails, the rail sections, usually coming from the manufacturing factory in lengths of 36 meters, are welded abutting in succession one after the other to form sections of 144 meters, which are transported to the laying place. There, after having been laid down by an operating train, the sections are welded abutting in succession one after the other in order to form final lengths of 288 or 432 meters, or any other fixed length. The welding is done by an electric spark process, or by an aluminothermic process, onto the already laid down rails. Conventionally, the rail sections to be laid down were laid onto the ground alongside the railroad line, but it is already known through improvements already introduced that the rail sections having the length of 144 meters are charged onto special trucks on which also the ties are carried, and which are provided with guides for a portal crane, used for transporting the ties to be laid down and, in case, the removed old ties. The rails are charged in a position underlying the charge of ties, and both the rails and the ties are fed to a special machine, being a part of the operating train, which provides for laying down the new rails and ties, possibly after removing the old ties and rails to be replaced, and in case for effecting other operations too. However, the welding of already laid down rail sections should be performed by a spark welding machine mounted onto a special railroad truck which operates following the operating train, but such a machine is very expensive and needs skilled personnel. Moreover, rather complicated operations, special equipment and correspondingly skilled personnel are needed in order to arrange to line and level the ends of the rail sections to be welded, and to keep the ends of the rail sections being laid pushed against the ends of the already laid down rail sections. It is also necessary that rest plates and correspondingly fixing screws are temporarily dismounted from the ties (and subsequently mounted again), which are included in the region in which the head of the welding machine is required to operate.

SUMMARY OF THE INVENTION

The object of this invention is to improve the process through which the rail sections being laid down are welded to the already laid down rail sections, in order that the expenses for the needed equipment are considerably reduced and the necessary personnel and preliminary labour are limited.

To this purpose, the invention proposes to insert into the operating train, between the trucks which carry the new rail sections and ties, and the machine which lays them down, a particularly equipped train set, and to effect on this equipped train a set the operations for arranging to line, to level and to abut the subsequent rail sections, as well as their welding, whereby the whole cycle of operations having reference to the welding is accomplished on board the operating train itself, and the laying down is done by the corresponding machine on already continuous rails.

Preferably, the welding of the rail sections is done by welding machines which are movable along the equipped train set,. the welding operation being performed during a stroke of the welding machines with respect to the train set in a direction opposite the forward direction of the operating train, and said welding stroke being subsequently compensated by a return stroke of the welding machines with respect to the equipped train set, in the same direction as the forward direction of the operating train.

Due to this procedure, all preliminary labor and any operation for arranging to line, to level and to abut, as well as the welding operations, subsequent to the laying down of the rails, are avoided, and all such operations take place on board of the operating train, and therefore with the aid of any suitable equipment capable of rendering such operations more easy, precise and protected. Particularly, there is no more need for using a welding machine carried by a special railroad truck which operates following the operating train, thus avoiding the high cost of such a machine and the personnel needed for its control, as well as the mentioned operations for dismounting and then mounting again a number of supporting plates and fixing screws in the welding region.

The equipped train set intended to allow carrying out the process according to the invention comprises one or more tracks each having a lowered load platform, which tracks carry welding machines suitable for mutually welding the butting ends of the rail sections.

Preferably said equipped train set comprises: first side guides for the travel of a portal crane intended for transporting the ties; second guides having a gauge smaller than that of said first guides; and a self propelling trolley which travels on said second guides and carries the welding machines.

More particularly, each said welding machine may comprise a welding head and a current generator group for feeding the same. The trolley may be provided with telescopic arms with grasping jaws in order to effect the operations for seizing, abutting and, in case, approximately putting to line and level the subsequent rail sections to be welded. Hydraulic jaws may be provided in order to automatically carry out the final operation for putting to line and level the rail sections to be welded.

BRIEF DESCRIPTION OF THE DRAWINGS

The above and other features and advantages of the subject matter of this invention will appear more clearly from the following description of a preferred embodiment, which however is only one example, of a part of an operating train equipped according to the invention, diagrammatically shown in the appended drawings, wherein.

DETAILED DESCRIPTION OF THE PREFERRED EMBODIMENT OF THE INVENTION

Figure 1:
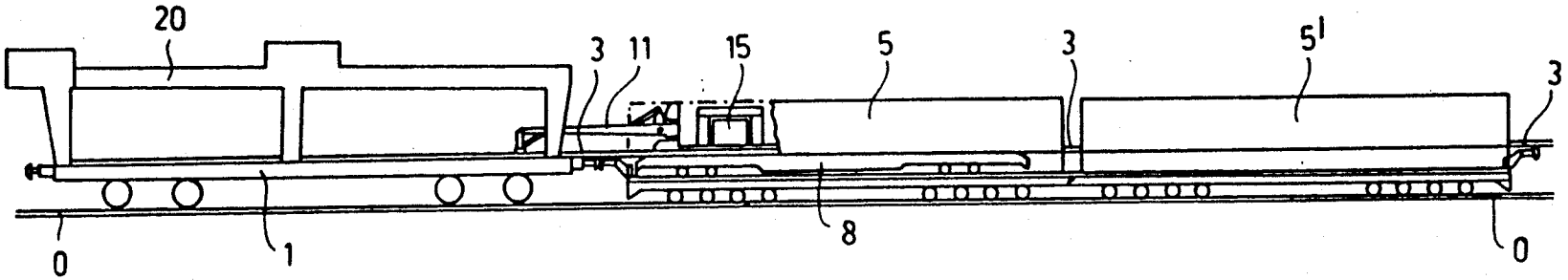
FIGS. 1 and 2, to be considered as forming the continuation of each other, show on an extremely reduced scale and in an extremely diagrammatic way a part of an operating train which comprises, along with known components, the equipped train set according to the invention.
Figure 2:
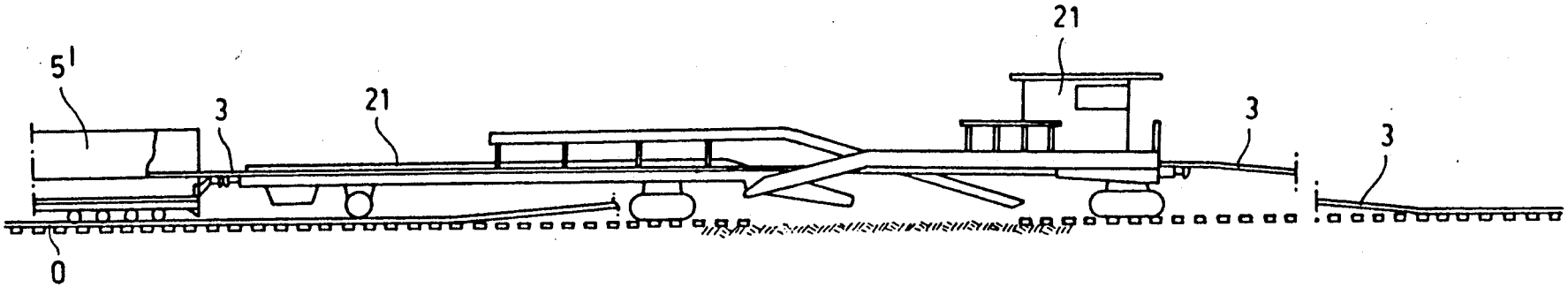
Figure 3:
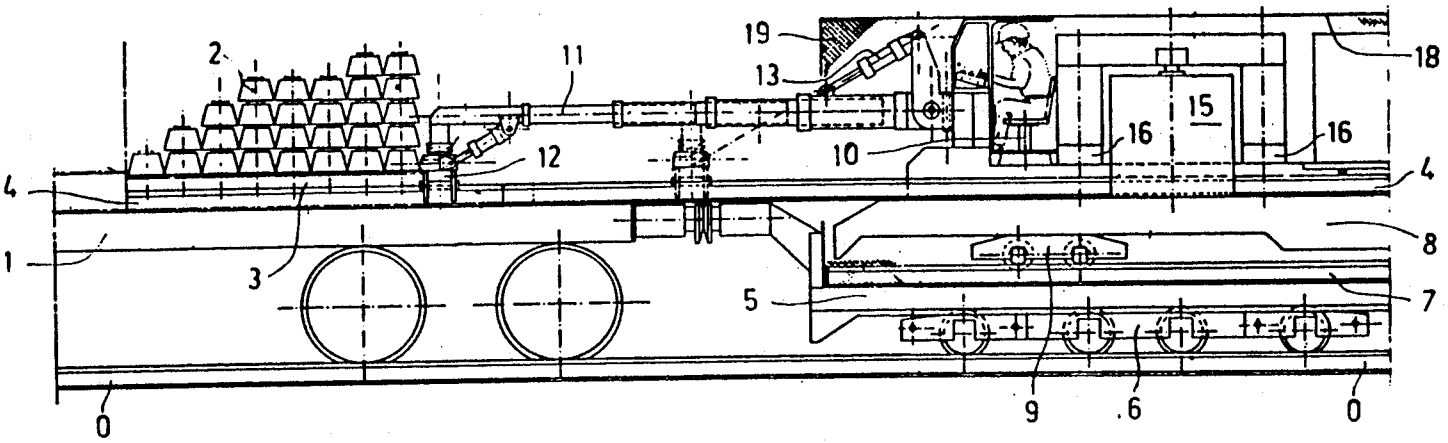
FIG. 3 shows a side elevational view of the front part of an equipped train set according to the invention, hooked following a known truck for transport of rail and ties, which truck is a part of an operating train.
Figure 5:
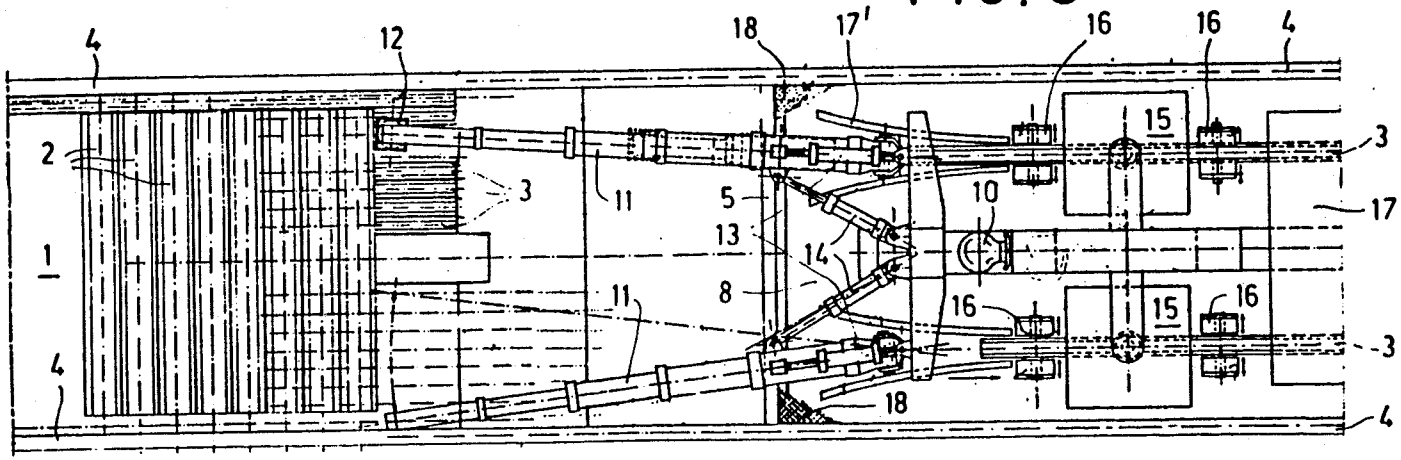
FIGS. 5 and 6, to be considered as forming the continuation of each other, show in plan view the same parts of the operating train shown in FIGS. 3 and 4, respectively.

The operating train diagrammatically shown in FIGS. 1 and 2 comprises: a truck 1 (known), which carries the materials to be laid down, and on board of which there is a portal crane 20 (also known); an equipped train set (according to the invention), formed in this case by two trucks 5 and 5'; and an operating machine 21 (known), which removes the old rails 0 onto which travel the trucks 1, 5, 5' and the front part of the operating machine 21 itself, lays down the new already welded rails 3, and effects any other foreseen operation, such as the removal of the old ties on which the old rails 0 were mounted, and the laying down of the new ties whereon the new rails 3 are to be laid down Referring to FIGS. 3 and 5, a truck 1, known per se, travels on the old rails 0 to be changed, and carries the materials to be laid down, namely new ties 2 and rail sections 3. The same truck 1 in another region, or even other trucks (not shown), may also receive the old materials removed, if such a removal operation of old materials is effected by the operating train too. The truck 1 is illustrated sideways, in a known manner, with guides 4 which are intended to be travelled by the portal crane 20 (per se known and diagrammatically shown in FIG. 1). The crane 20 periodically transports the new ties to be laid down from truck 1 up to the operating machine 21 (diagrammatically shown in FIG. 2), which is located rearwards within the operating train. In case, the same crane 20 also transports towards truck 1 the old ties removed by the operating machine 21.

Figure 4:
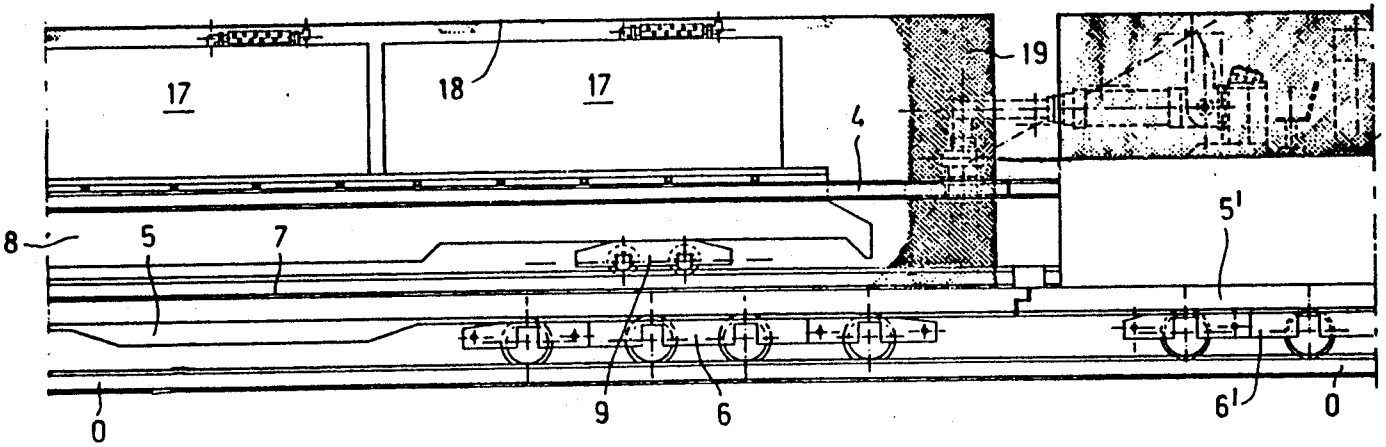
FIG. 4, to be considered as a continuation of FIG. 3, shows in a similar manner the rear part of the known truck comprised in the equipped train set according to the invention, hooked to a following truck also being a part of the equipped train set.
Figure 6:
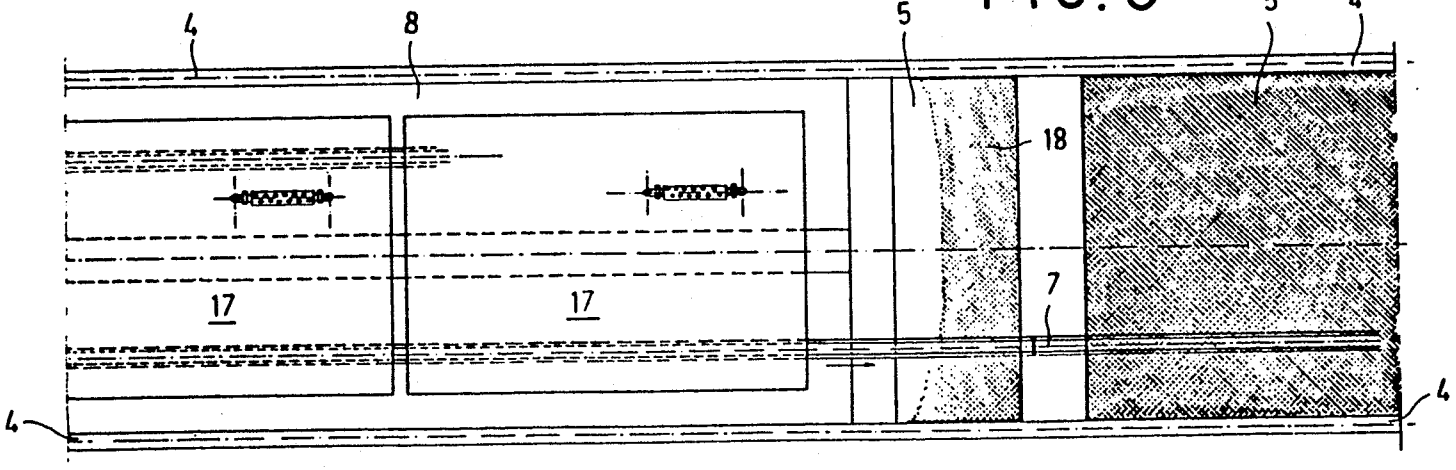

To the truck 1 is hooked, according to the invention, an equipped train set comprising a first truck 5 with a lowered load platform, which travels by bogies 6 on the rails 0. Another identical truck 5' (FIGS. 4 and 6), resting on bogies 6', or even several such identical trucks (not shown), may follow the truck 5 when the length thereof is not sufficient per se for allowing the operative strokes needed by the invention. The truck 5 is provided, as seen in FIG. 3, with first side guides 4, identical and corresponding to the guides 4 of truck 1, in order to allow travel of the already mentioned portal crane 20. On truck 5 there are moreover mounted second side guides 7, which have a gauge smaller than that of the first guides 4, and preferably are located at a level lower than the first guides 4. In those cases in which several trucks 5, 5' and so on are provided for forming the equipped train set, it is needed that among them the continuity of the guides 7 is ensured, and moreover the continuity of the first guides 4 should be ensured both among them and with respect to the foregoing and following trucks of the operating train.

On the guides 7 of the equipped train set, as seen in FIG. 5, there is mounted a trolley 8 (preferably a self propelling one) which travels by means of wheel groups 9. Near the front end of trolley 8 there is provided a control station 10, from which a sole operator may control all the operations directly or indirectly having reference to the welding of rail sections. Onto the trolley 8 there are mounted and hinged two arms 11, which may be telescopically extended and are hydraulically operated, which arms end with jaws 12 and may be oriented in height by hydraulic cylinders 13 and laterally by hydraulic cylinders 14.

On trolley 8 there are also mounted two welding heads 15, and each of them is precede and followed by hydraulic jaws 16 intended to put to line and level the rail sections. Preferably there are also guides 17' which converge towards the front jaws 16 in order to facilitate the entry of rail sections 3 in said jaws. If the electric energy generators for feeding the welding heads 15 are mounted as near the same as possible, it is preferable that the trolley 8 further carries two motor-generators 17 in order to provide for this feeding, although, in case, said generators could also be arranged in a different manner on board of the operating train. Moreover, any other suitable service equipment may be mounted on trolley 8.

Preferably the whole equipped train set is covered by a roofing 18 and is protected sideways by a net 19 (these parts having been partially removed in the Figures in order to show the inner components of the train set), whereby all work is done sheltered from the atmosphere and the operators are also protected with respect to the trains which may travel on lines located along the sides of the line on which the work is being done.

The operation of the described equipment, which carries out the process according to the invention, is as follows.

It is assumed that the trolley 8 is located in the shown position, namely displaced towards the front end of the first truck 5 of the equipped train set, and that a pair of rail sections 3 already formerly welded to the rail sections being laid down is sliding with respect to the truck 5. This sliding movement of the rails with respect to the train set is due, in reality, to the fact that the operating train, and with it the train set comprising the truck 5, is advancing on the rails 0, whereas the new rail sections 3, being already welded to the sections being laid down and to the formerly laid down sections, are unmovable with respect to the ground and, therefore, they displace rearwards with respect to the train set.

The operator, from the control station 10, activates the telescopic arms 11 in order to seize by means of the jaws 12 a pair of rail sections 3 charged on the truck 1, and handles them in such a way that they abut and then remain in abutment against the ends of the already welded rail sections being laid down. This maneuver may preferably be done in a single step, if the length of the operating field of the telescopic arms 11 and the arrangement of the rail sections allow it; in the contrary case, however, the maneuver may still be performed in several steps of extension and retraction of the telescopic arms 11. The guides 17' facilitate forwarding the new rail sections 3 towards the front jaws 16. With the aid of suitable marks, this operation is continued until the points separating the ends of the thus abutting rail sections 3 are in register with the welding heads 15.

At this point the hydraulic jaws 16 are tightened, and they put exactly to line and level the abutting rail sections. At the same time these jaws 16 render the trolley 8 temporarily solid with the welded rail sections 3 being laid down. Then, the welding heads 15 may be put in operating position, and they may be activated in order to cause a spark production between the abutting ends of the rail sections 3, thus causing them to melt and to weld together. This step involves an upsetting of the joint regions, and therefore during this operation the front hydraulic jaws 16 should be released, thus allowing a suitable advancement of the formerly clasped rail sections. Also the jaws 12 of the telescopic arms 11 may be released, and the arms 11 may be loosened, because their action is no more needed for the time being.

Since due to the tightening of jaws 16 and the operation of the welding heads 15 these parts and the trolley 8 which carries them have become solid with the already welded rail sections being laid down, they follow the displacement thereof with respect to the equipped train set, and therefore the whole trolley 8 displaces towards the rear end of the operating train. This behavior continues until the welding being performed by the welding heads 15 is ended and the melted material has solidified; the time needed for these operations may be, for example and typically, about 180 seconds. After the time needed, the welding heads 15 may be released and the rear jaws 16 may be released too.

Due to the latter operations, the trolley 8 stops its rearward movement with respect to the equipped train set, and it may be displaced forward again in order to resume its advanced starting position. This return displacement of the trolley 8 may be operated by any preferred means, but it is of advantage if, to this purpose, the trolley 8 is self propelling. After the trolley 8 has taken its starting position again, the described cycle may be repeated from start to finish in order to weld two further rail sections 3.

The length of the displacement of trolley 8 relative to the equipped train set depends on different factors, such as the advancement speed of the operating train, the welding and cooling times and so on. If the length may be comprised within the length limits allowed for a single truck 5, the train set may be formed by this single truck 5 only. However, in certain cases it is needed, or at least it is suitable, to use several trucks 5, 5' and so on, which follow each other within the operating train in order to form the equipped train set. Alternatively, one can slow down or momentarily stop the operating train during the execution of the welding operations.

Of course, when the welding has been done, the weld regions are further processed in a way per se well known, by removing with the aid of tools the upset metal and then grinding and correcting the profile of the railhead. Such operations may be executed by means of equipment (not shown) mounted on suitable points of the equipped train set, before the rails are forwarded to the laying down tools of the operating machine 21.

The action of the hydraulic jaws 16 allows automatically putting to line and level the rail sections, thus obtaining in a reduced time more precise results than are usually obtained on the laid down rails after relatively long and difficult operations. The execution of the welding operations by suitable welding heads 15 may be performed in conditions and by processes more advanced than they may be performed onto the already laid down rails. The process according to this invention may be advantageously combined with a process for thermal regulation, and in such a case the rails may be fixed to the ties immediately after passage of the operating train, because no further intervention on the rails is needed. Although the welding equipment mounted onto trolley 8 may be more advanced than that usually employed, its cost is greatly lower than that of a spark welding machine mounted onto a special railway truck in order to operate on the already laid down rails. Finally, the need for labor is drastically reduced.

Therefore, thanks to the use of the process according to the invention and to its carrying out by means of the equipped train set, also being a subject of the invention, it is possible to simplify, well organize and render more economical the operations for laying down rails and welding them, by reducing the equipment and labor costs and ensuring obtainment of technically more precise results.

The provision of the trolley 8 carrying the welding machines allows performing all operations having reference to the welding without slowing down or stopping the operating train, or at least by limiting the slowing down and stop periods, however it should be understood that this invention may also be carried out in a simplified manner if one stops the operating train during the welding period or a part thereof; in such a case the welding machines may be directly mounted onto the equipped train set, and there is no need for foreseeing a movable trolley.

Although this invention has been described with reference to a specific embodiment, different modifications stated and others, as well as any replacement by technically equivalent means, may be made within the scope of the appended claims.

This invention may be applied in general in all industrial operations for installing and/or renewing railroads, which operations involve laying down rail sections intended to be welded to the rail sections already formerly laid down.

I claim:

1. A process for continuously welding railroad rail sections from an operating train having at least one truck (1) which carries new ties (2) and new rail sections (3), and an operating machine (21) which lays down the new ties (2) and the new rail sections (3), said process comprising the steps of:

inserting an equipped train set (5, 5') between the truck (1) and the operating machine (21);

arranging to line, to level, to abut, and to weld the rail sections (3) on the equipped train set (5, 5'); and laying down the rail sections (3) by the operating machine (21) on already continuous rails;

whereby welding is done by heads (15) which are guided along the longitudinal axis of the equipped train set (5, 5'), said welding being performed during a stroke of the heads (15) with respect to the equipped train set (5, 5') in a direction opposite to a forward direction of the operating train, said stroke being subsequently compensated by a return stroke of the heads (15) with respect to the equipped train set in the same direction as the forward direction of the operating train, thus obviating a need to interrupt advancement of the operating train during said welding.

2. The process as set forth in claim 1, wherein said arranging step includes the substeps of:

gripping the new rail sections (3);

transferring the new rail sections (3) from the truck (1) to the equipped train set (5, 5'); and abutting the new rail sections (3) against already welded rail sections.

3. The process as set forth in claim 1, wherein said arranging step further includes the substep of:

putting in line and on level the rail sections (3).

4. An equipped train set for continuously welding railroad rail sections (3), said train set comprising:

at least two trucks (5, 5'), each having a lowered load platform;

head means (15) for mutually welding abutting ends of the rail sections (3);

first side guides (4) and second side guides (7) mounted onto the trucks (5, 5') and extending along the longitudinal axis of the trucks; and trolley means (8), guided on the second side guides (7), for carrying the welding head means (15) thereon.

5. The equipped train set as set forth in claim 4, wherein:

said trolley means (8) is self-propelling.

6. The equipped train set as set forth in claim 4, further comprising:

motor means (17), carried by the trolley means (8), for feeding electric current to the welding head means (15).

7. The equipped train set as set forth in claim 4, further comprising:

a control station (10) mounted atop the trolley means (8);

telescopic arms (11) extending from the control station (10); and jaw means (12), attached at ends of the telescopic arms (11), for grasping, abutting, and putting in line and on level the rail sections (3).

8. The equipped train set as set forth in claim 4, further comprising:

hydraulic jaw means (16), located in front of and behind the welding head means (15), for putting in line and on level the rail sections (3).

9. The equipped train set as set forth in claim 8, wherein:

said hydraulic jaw means (16) renders the trolley means (8) rigid with respect to the rail sections (3) already welded while putting in line and on level the rail sections (3) to be welded.

10. The equipped train set as set forth in claim 7, wherein:

said control station (10) is provided with a roof means (18) and a side net means (19) for protecting an operator.

* * * * *